United States Patent [19]

Leonhardt

[11] 3,940,816

[45] Mar. 2, 1976

[54] SIDE LASTING APPARATUS

[76] Inventor: Horst M. Leonhardt, 50 Charles St., East Weymouth, Mass. 02189

[22] Filed: Aug. 8, 1974

[21] Appl. No.: 495,813

[52] U.S. Cl. ..... 12/7
[51] Int. Cl.[2] ..... A43D 21/00
[58] Field of Search ..... 12/7, 8.1, 8.3

[56] References Cited

UNITED STATES PATENTS

| | | | |
|---|---|---|---|
| 2,239,737 | 4/1941 | Rohrer | 12/7 |
| 2,455,106 | 11/1948 | Wirtz | 12/7 |
| 3,678,522 | 7/1972 | Bumbatek et al. | 12/8.1 |

*Primary Examiner*—Patrick D. Lawson

*Attorney, Agent, or Firm*—Robert T. Gammons

[57] ABSTRACT

Side lasting apparatus comprising a support for supporting a last, bottom side up and lasting instrumentalities supported at opposite sides of the last support between which a last mounted on the support with the lasting margin of an upper thereon projecting upwardly from the bottom is adapted to be moved by the support and wherein said instrumentalities are yieldably displaceable laterally and vertically by entrance of the last therebetween. There are flexible elements carried by the instrumentalities conformable to the shoulders of the last at each side by such displacement to fold the lasting margin inwardly over the bottom of the last as the last is moved between the instrumentalities.

18 Claims, 9 Drawing Figures

SIDE LASTING APPARATUS

BACKGROUND OF INVENTION

Side lasting in the art is carried out in general by two types of lasting apparatus, to wit, the kind of lasting machine wherein the last is mounted on a jack, pinchers are employed to take hold of the lasting margin to pull the margin taut and reciprocal wiper blades are then moved parallel to the bottom to take the lasting margin from the pinchers and stretch it across the bottom and the Kamborian progressive type of lasting apparatus wherein a last with an upper mounted thereon with its lasting margin projecting upwardly from the bottom, is presented by the operator to a pair of constantly rotating gripping rolls which pull the lasting margin increment by increment upwardly over the side of the last and more or less perpendicular to the bottom and a rotary wiper which takes the taut lasting margin from the gripping rolls and forces it inwardly over the bottom. In each of the aforesaid apparatus the lasting margin may be pre-cemented or adhesive may be applied to the lasting margin just before the lasting instrumentalities operate to fold the lasting margin against the bottom. The latter type is not automatic but requires the constant attention and considerable cooperation of the operator. The apparatus of this invention is designed to be substantially automatic in its operation and to effect lasting of both sides of the shoe at once in a progressive fashion, that is, increment by increment without the assistance or need for manipulation by an operator other than to place the last on the last support.

SUMMARY OF INVENTION

As herein illustrated, the apparatus comprises means for moving a last bottom side up along a predetermined path with an insole and upper mounted thereon and with the lasting margin projecting upwardly from the bottom, instrumentalities supported at opposite sides of the path of movement for engagement with the sides of the last substantially at the shoulders, said instrumentalities being yieldably pressed against said shoulders and rotatably about axes inclined to the bottom of the last such as to present a succession of working surfaces into engagement with the shoulders as the last is moved along said path relative to the instrumentalities and wherein said instrumentalities are comprised of a series of deformable elements supported with portions above and below the bottom of the last at angles to the bottom of the last and as they are successively displaced by the last press the lasting margins over the shoulders and inwardly against the bottom.

The lasting instrumentalities are movable inwardly toward opposite sides of the last support and downwardly with respect thereto and there is means yieldably opposing their displacement. Each instrumentality is freely rotatable relative to the shoulder of the last as the last is moved relative thereto to present a succession of narrow working surfaces to the sides of the last for progressively and incrementally applying lasting pressure to the lasting margin. Each instrumentality comprises a shaft supported in a position inclined downwardly and outwardly with respect to the bottom of the last, axially spaced hubs on the shaft one of which is substantially above the bottom of the last and the other is substantially below the bottom of the last, a plurality of flexible elements fastened at their ends to the hubs so as to be stressed therebetween the means yieldably resisting displacement of the elements. Each element is fastened to the upper hub and is connected to the lower hub by a spring and may comprise a strip of leather, web ducking or rubber. The elements are spaced about the hub at uniformly spaced intervals to provide gaps therebetween and the upper hub has at its inner side an inclined surface which is substantially parallel to the bottom of the last so as to apply pressure to the portion of the displaced element overlying the bottom. The last support comprises a pair of disks mounted on a horizontal shaft for rotation in a plane midway between the lasting instrumentalities, the edges of which carry yieldable gaskets which define an annular groove, the walls of which converge, to receive the neck of the last placed on it. The last support is motor driven to carry a last placed on it upwardly and between the lasting instrumentalities and following lasting to move away from the lasting instrumentalities at the opposite side.

The invention will now be described in greater detail with reference to the accompanying drawings, wherein.

Figure 1:
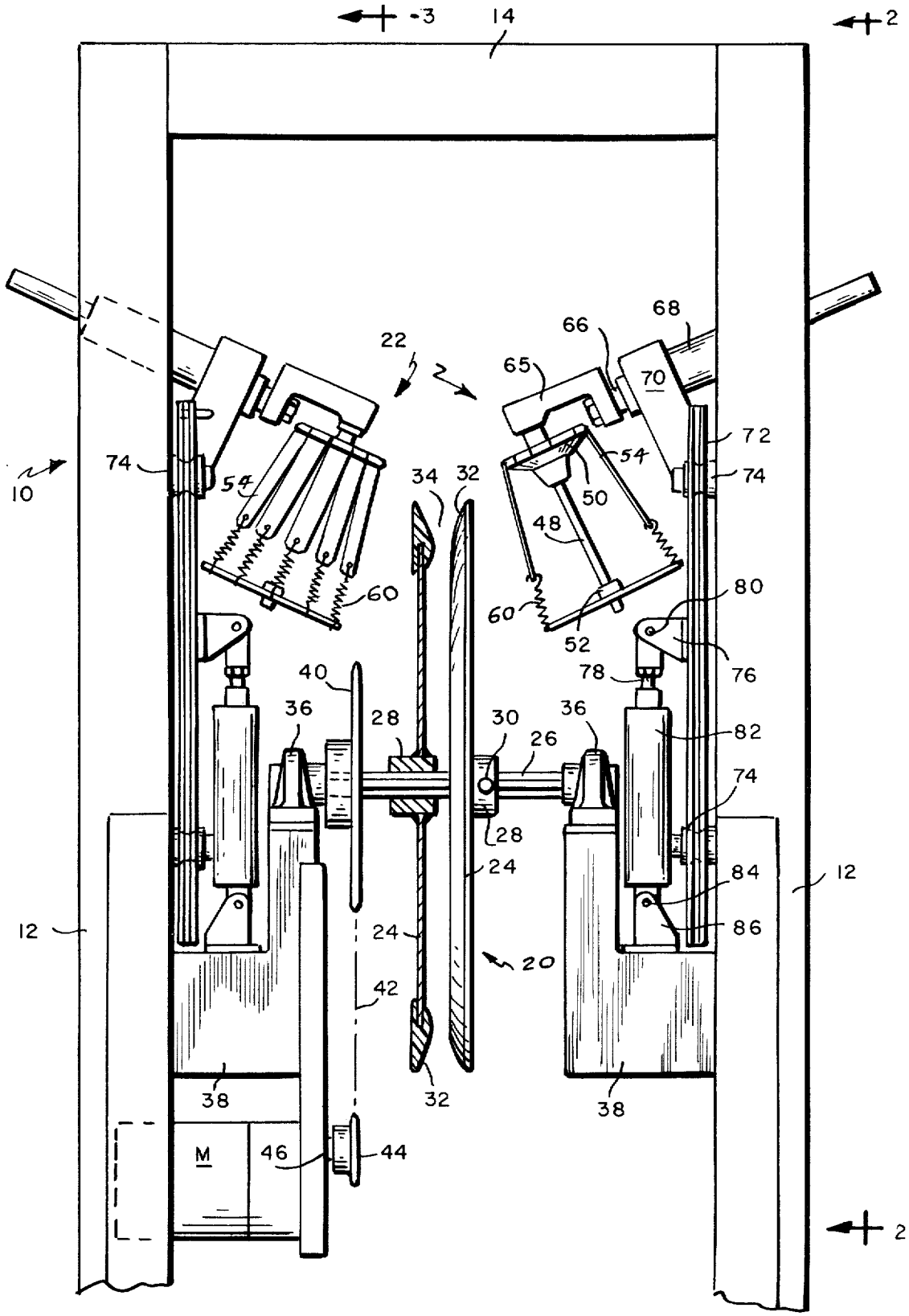
FIG. 1 is an elevation of the lasting apparatus of this invention with parts in section.
Figure 3:
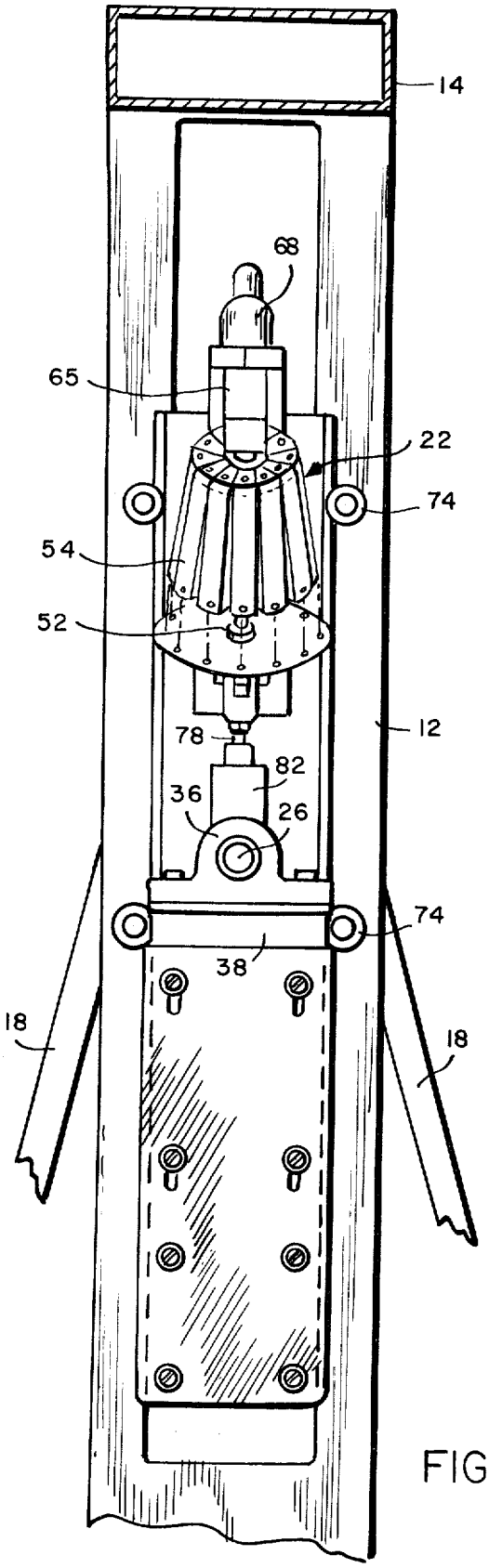
FIG. 3 is an elevation taken on line 3—3 of FIG. 1.
Figure 2:
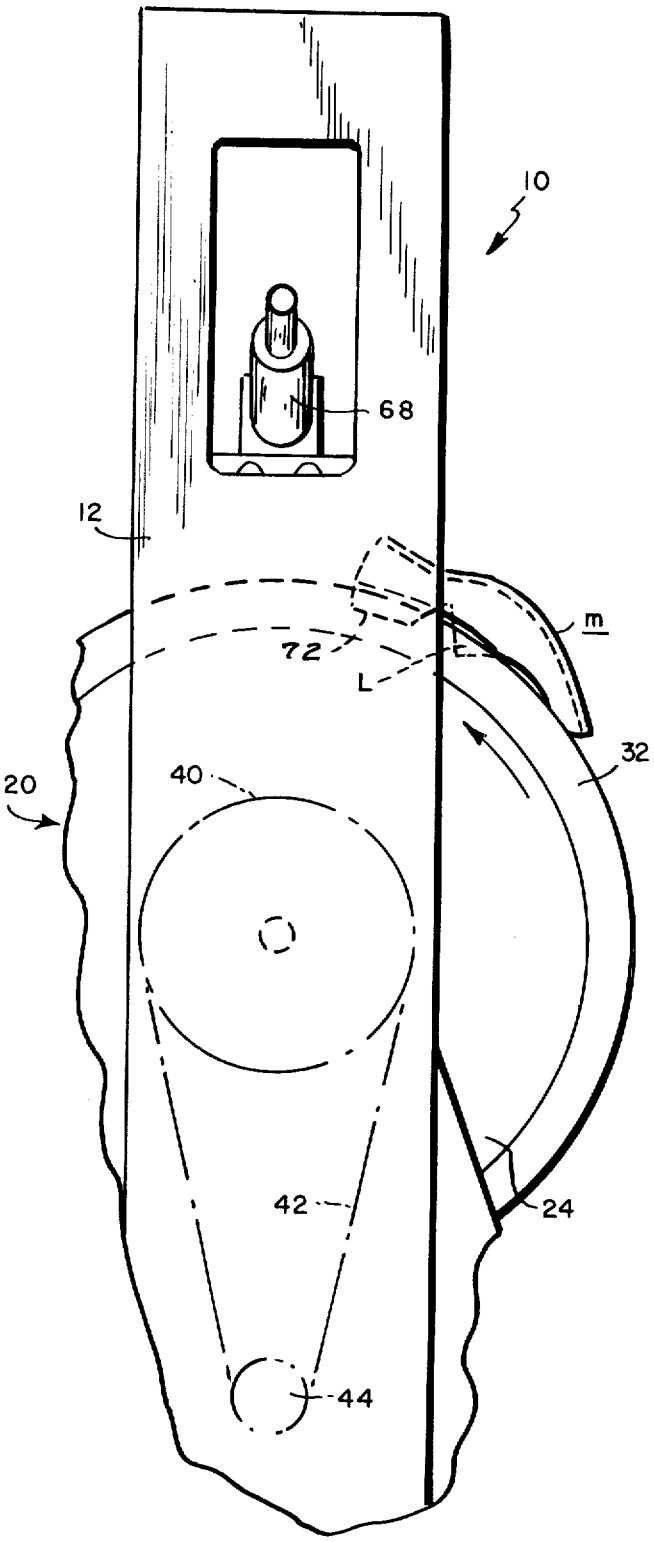
FIG. 2 is a fragmentary elevation taken on line 2—2 of FIG. 1.

Referring to FIGS. 1 and 2 the apparatus as herein illustrated is provided with a supporting frame 10 comprising uprights 12—12 joined at their upper and lower ends by suitable cross-bracings 14. To provide a stable structure angle bracings 18—18 is employed to steady the frame on its base.

Mounted on the supporting frame 10 are a last support 20 for lasts on which are mounted uppers for the side lasting operation and side lasting instrumentalities 22—22 mounted at opposite sides of the last support 20.

The last support 20 for the lasts, and by means of which lasts are presented to the wiping instrumentalities for lasting, comprises a pair of flat circular disks 24—24 mounted on a horizontally disposed shaft 26 by means of hubs 28—28 at their centers containing openings for slidingly receiving the shaft so that the distance between the disks may be adjusted for lasts of different size. Set screws 30—30 threaded into the hubs provide for securing the disks at a predetermined spacing. Peripherally of each disk there is a flexible gasket 32 the cross section of which is such that the gaskets on the two disks collectively define between them an annular space 34 which has radially divergent surfaces for receiving the neck *n* of the last L which is to be presented to the wiping instrumentalities. As shown in FIG. 2, a last with an upper *u* and insoles mounted thereon and with the lasting margin *m* of the upper projecting vertically from the bottom is placed bottom side up on the last support with the neck *n* of the last engaged between the gasket members 32—32 and is allowed to be carried upwardly in the direction of the arrow, that is, heel end first, between the lasting instrumentalities 22—22 without need for the operator holding onto the last.

The shaft 26 is supported at its opposite ends in bearing members 36—36 which are in turn mounted on brackets 38—38 secured to the uprights 12—12. A sprocket 40 is fixed to the shaft 26 and rotation of the shaft 26 is effected by a chain 42 entrained at one end about the sprocket 40 and at its other end about a sprocket 44 fixed to a shaft 46 driven by a motor M.

Figure 6:
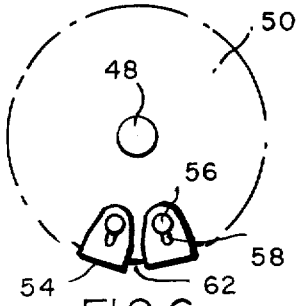
FIG. 6 is a top view of FIG. 5.

The wiping instrumentalities 22—22 as related above are supported at opposite sides of the last support 20 and are mounted on the frame at a spacing to receive between them the sides of a last mounted on the last support for the last and to resist lateral and upward displacement by movement of the last therebetween. Each instrumentality 22 comprises a shaft 48 on which there are mounted in axially spaced relation an upper hub element 50 and a lower hub element 52. Between the two hubs there are mounted peripherally and in uniformly spaced relation elements 54 which are flexible and which may be comprised of leather, webbing, rubber or the like. The upper ends of the elements 54 are fixed by pins 56 or their equivalent to the outer edge of the hub 50. These pins may be fixed in the face of the hub and the elements provided with slots 58 to enable engaging them over the heads of the pins for easy replacement if they become damaged. The lower ends of the elements 54 are connected to the peripheral edge of the lower hub by springs 60. As will be seen by reference to FIG. 6 the elements are spaced uniformly about the hubs with gaps 62 between elements so that the edges 64 of the respective elements are exposed.

Each shaft 48 is rotatably supported at its upper end in an L-shaped bracket member 65, FIG. 1, fastened to a piston rod 66 protruding from a cylinder 68 mounted on the uprights 12 in an inclined position so that the axis of the shaft 48 inclines downwardly and outwardly relative to the support for the lasts. The cylinder 68 is supplied with air under pressure so that the lasting instrumentality fixed to the end of the rod will resist lateral displacement according to the pressure supplied to the cylinder 68.

The mounting for the cylinder 68 comprises a bracket member 70 which in turn is bolted to a plate 72 mounted on the upright 12 between guide rolls 74—74 for vertical movement. A bracket 76 is fastened to the inner side of the plate 72 to which one end of a piston rod 78 is pivotally connected by a pin 80 The piston rod 78 extends from a cylinder 82 pivotally connected by pin 84 to a bracket 86 fastened to the bracket 38. Pressure is supplied to the upper end of the cylinder 82 so as to hold the rod 78 fully retracted and thus the plate 74 and the lasting instrumentality mounting thereon in its lowermost position with respect to the support for the last.

Figure 4:
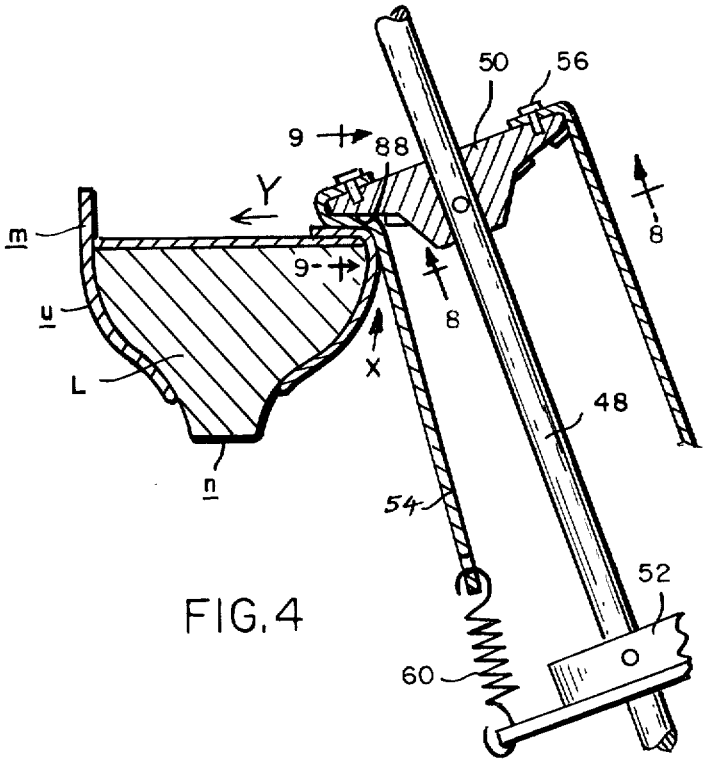
FIG. 4 is an enlarged fragmentary view partly in section showing the application of one of the wiping instrumentalities to the side of a last.
Figure 5:
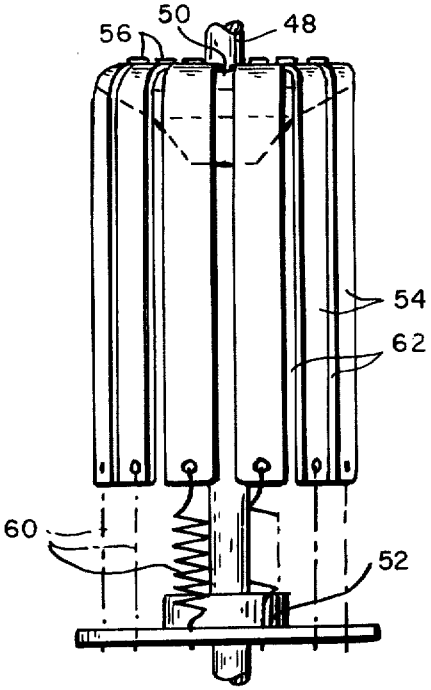
FIG. 5 is an elevation of the lasting instrumentality removed from the apparatus.
Figure 7:
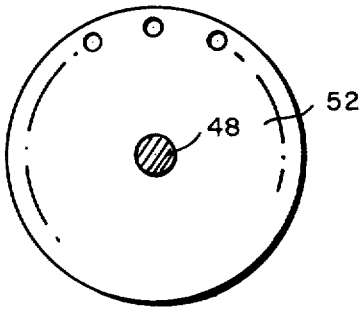
FIG. 7 is a bottom view of FIG. 5.
Figure 8:
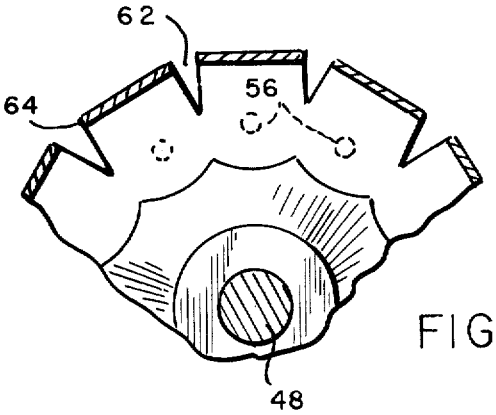
FIG. 8 is a fragmentary section taken on the line 8–8 of FIG. 4.
Figure 9:
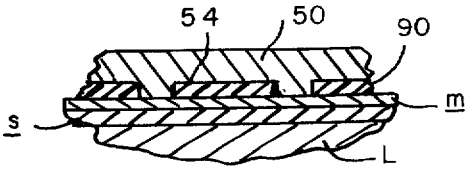
FIG. 9 is a fragmentary section taken on the line 9—9 of FIG. 4.

As thus constructed, when a last with an upper mounted thereon with its lasting margin projecting from its bottom surface is placed on the last support 20 between the lips of the gasket members 32—32 it is carried around the heel end first into engagement with the wiping instrumentalities and as it enters between them it displaces the elements 54 at each side laterally against the pressure forcing the instrumentalities inwardly and the pressure pulling the instrumentalities downwardly. The result is that the elements 54 which are flexible are deflected so as to wrap around the lower part of the last, shoulder, and on to the bottom and by such wraparound to fold the lasting margin downwardly and push it inwardly. The displacement produced by the last operates because of the spring loaded lower ends of the elements to apply a force upwardly toward the bottom in the direction of the arrow, FIG. 4, and a force inwardly over the bottom substantially parallel thereto in the direction of the arrow Y. The lasting forces are applied as the last is moved between the instrumentalities by rotation of the lasting instrumentalities in opposite directions to progressively bring the elements 54 successively into engagement with successive incremental portions of the lasting margin, thus the lasting process is a progresssive lasting of the upper to the last from the heel end toward the toe end which stretches the upper in the most optimum direction for producing a snug heel and obtaining a sufficient lasting allowance at the toe to enhance the toe lasting operation. The upper hubs 50 of the lasting instrumentalities have on their inner sides inclined surfaces 88-88 which are substantially parallel to the bottom of the last and when the last is moved between the instrumentalities and displaces the elements the inclined surface 88—88 apply pressure to the upper parts of the elements overlying the bottom more or less perpendicular to the surface which is particularly effective and useful if the lasting margin is pre-cemented or cement is applied to the lasting margin just before it is laid down to achieve good adherence. The surfaces 88—88 contain slots, FIG. 9, for receiving the elements 54 so as to provide a substantially flat surface for engagement with the margin. It is also to be observed that there are gaps between successive elements 54 so that the edges 64 of these elements are more or less exposed and as the last is moved between the lasting instrumentalities these edges frictionally grip and rub the lasting margins into place.

As the last is moved beyond the lasting instrumentalities it is carried by the last support clear of them so that it may be stripped from between the last supporting disks by suitable means or merely removed by the operator.

The apparatus is relatively simple, requires power for its operation only as to effecting rotation of the support for the lasts, the lasting instrumentalities themselves being free to rotate and a supply of air pressure for the cylinders 68 and 82 which respectively hold the lasting instrumentalities adjacent the opposite sides of the support for the last and at their lowermost position with respect thereto.

It is apparent from the foregoing construction that the apparatus is especially suitable for receiving lasts of all sizes and of all depths regardless of whether they are flat-bottomed or have a high arch because of the fact that the lasting instrumentalities are permitted to yield laterally and also vertically to follow the contour of the last without restraint.

The apparatus is substantially automatic in that the operator has only to place a last on the last support and the lasting will be accomplished without further manipulation.

It should be understood that the present disclosure is for the purpose of illustration only and includes all modifications or improvements which fall within the scope of the appended claims.

I claim:

1. Apparatus for applying a wiping stress to the upstanding lasting margin of an upper mounted on a last, comprising a support for a last, an instrumentality mounted adjacent the support for the last, said instrumentality embodying a series of flexible elements supported in a plane inclined downwardly and outwardly relative to the side of the last, means yieldably pressing the instrumentality towards the side of the last such that as each element is brought into engagement with the shoulder of the last it is stretched about the shoulder of the last against the bottom and non-yielding means freely rotatable in the direction of movement of the last to which the upper ends of the elements are attached having a surface disposed substantially parallel to the bottom of the last such as to apply a force to that part of the element engaged with the bottom which is substantially perpendicular thereto.

2. Apparatus according to claim 1, wherein the instrumentality is movable heightwise with respect to the bottom of the last and is yieldably urged downwardly toward the bottom.

3. Apparatus for applying a wiping stress to the upstanding lasting margin of an upper mounted on a last comprising a support for the last, an instrumentality adjacent the support, said instrumentality embodying a plurality of elongage flexible elements, means supporting the instrumentality for rotation about an inclinded axis from above the bottom of the last downwardly and outwardly therefrom such that rotation of the instrumentality about said axis brings each element successively into a plane intersecting the path of movement of the shoulder of the last, and means for advancing the last relative to the instrumentality to bring the elements successively into engagement with the shoulder of the last.

4. Apparatus for applying a wiping stress to the upstanding lasting margin of an upper mounted on a last comprising a support for a last, a shaft, a support mounting the shaft for rotation about an axis inclined downwardly and outwardly relative to the bottom of the last, axially spaced hubs fixed to the shaft, one substantially above the bottom of the last and the other substantially below the bottom of the last, a plurality of flexible elements fastened at their ends to the hubs so as to be stressed therebetween, and means yieldably resisting displacement of the shaft away from the side of the last presented thereto for lasting, to cause the successive elements to become warped about the side and shoulder of the last as they are rotated into engagement therewith.

5. Apparatus according to claim 4 wherein the lower ends of the elements are connected to the lower hub by spring means.

6. Apparatus according to claim 4 wherein the upper hub has a peripheral surface arranged to overlie the bottom of the last and to be substantially parallel thereto at a distance corresponding substantially to the thickness of the elements, to press the portions of the elements overlying the bottom against the bottom and to apply a rubbing force thereto.

7. Apparatus according to claim 4 wherein the elements are spaced about the hubs at equal intervals.

8. Apparatus according to claim 4 wherein the elements have spaced parallel longitudinally extending edges such that the forwardly moving edge of each element applies a rearwardly wiping force as well as an upward wiping force.

9. Apparatus according to claim 4, comprising a pneumatically operable piston for pressing the instrumentality against the shoulder of the last.

10. Apparatus according to claim 4, wherein the flexible elements are leather.

11. Apparatus according to claim 4, wherein the flexible elements are rubber.

12. Apparatus for applying a wiping stress to the upstanding lasting margin of an upper mounted on a last comprising a support for supporting the last for movement along a predetermined path, a shaft, a support for supporting the shaft for rotation about an axis inclined downwardly and outwardly relative to the path of movement of the bottom of the last, axially spaced hubs fixed to the shaft with one hub substantially above the other substantially below the bottom, a plurality of relatively narrow flexible elements attached at their ends to the upper and lower hubs at uniformly spaced intervals peripherally of the hubs such as to provide spaces between adjacent elements, means fixing the upper ends of the elements to the upper hub, spring means connecting the lower ends to the lower hub and means for effecting movement of the last along said predetermined path.

13. Apparatus according to claim 12, wherein the upper hub has a peripheral surface at its underside substantially parallel to the bottom which applies pressure perpendicular to the bottom and teeth at its edge which by engagement with the shoulder of the last as the latter is moved relative the the instrumentality effects rotation thereof.

14. Apparatus according to claim 12, wherein there is an instrumentality supported at each side of the last for operating on the two opposite sides of the last simultaneously.

15. Apparatus according to claim 14, wherein the support for the last is situated midway between the instrumentalities for advancing the last between the instrumentalities.

16. Apparatus for applying a wiping stress to the upstanding lasting margin of an upper mounted on a last, comprising a support for moving a last along a predetermined path with its longitudinal axis in the direction of movement, an instrumentality adjacent the support, said instrumentality embodying a plurality of elongate flexible elements movable successively into the path of movement of the shoulder of the last, said elements being inclined downwardly and outwardly relative to the plane of the bottom of the last in a plane intersecting the path of movement of the shoulder of the last such that at the place of engagement of an element with the shoulder of the last a portion of the element is stretched about the shoulder into engagement with the bottom of the last so as to fold the lasting margin inwardly against the bottom and means for effecting relative movement of the last and the instrumentality to bring the elements successively into engagement with the shoulder of the last.

17. Apparatus according to claim 16, wherein the elements are elastic.

18. Apparatus according to claim 16, wherein there is an instrumentality at each side of the last for simultaneous engagement with the shoulders at opposite sides of the last.

* * * * *